US005673796A

United States Patent [19]

Tulloch

[11] Patent Number: 5,673,796

[45] Date of Patent: Oct. 7, 1997

[54] GIFT BOX WITH REVERSIBLE DRAWER

[75] Inventor: John W. Tulloch, Malone, N.Y.

[73] Assignee: Wolverine World Wide, Inc., Rockford, Mich.

[21] Appl. No.: 582,479

[22] Filed: Jan. 3, 1996

[51] Int. Cl.[6] ..... B65D 5/38

[52] U.S. Cl. ..... 206/769; 206/459.5; 229/116.1; 229/125.125

[58] Field of Search ..... 206/457, 459.5, 206/758, 769–774, 776, 777; 229/125.125, 162, 116.1, 116.5

[56] References Cited

U.S. PATENT DOCUMENTS

| | | | |
|---|---|---|---|
| 358,722 | 3/1887 | Betsinger | 206/772 |
| 2,019,250 | 10/1935 | Collins | 206/777 |
| 2,058,648 | 10/1936 | Wellman . | |
| 2,313,376 | 3/1943 | Ullman . | |
| 2,541,173 | 2/1951 | Moore | 229/125.125 |
| 2,582,476 | 1/1952 | Buttery | 206/777 |
| 2,695,097 | 6/1954 | Easton . | |
| 2,711,819 | 6/1955 | Vander Lugt, Jr. | 206/777 |
| 3,262,559 | 7/1966 | Geiger . | |
| 3,357,543 | 12/1967 | Taggart . | |
| 3,451,612 | 6/1969 | Sinoto | 229/162 |
| 3,684,084 | 8/1972 | Kanzelberger | 229/125.125 |
| 4,955,469 | 9/1990 | Hudspith . | |

FOREIGN PATENT DOCUMENTS

| | | | |
|---|---|---|---|
| 685991 | 5/1964 | Canada | 229/125.125 |
| 2625726 | 7/1989 | France | 229/162 |

*Primary Examiner*—Jimmy G. Foster
*Attorney, Agent, or Firm*—Warner Norcross & Judd LLP

[57] ABSTRACT

A packaging box convertible from a box suitable for retail display of its contents to a box suitable for a gift box. The packaging box includes a sleeve and a drawer. The sleeve has a window opening in its top wall. When the drawer is inserted into the sleeve in a display mode, the interior of the drawer is visible through the window opening. When the drawer is inserted into the sleeve in a gift-box mode, the bottom wall of the drawer blocks the view of the interior of the packaging box through the window opening.

12 Claims, 2 Drawing Sheets

GIFT BOX WITH REVERSIBLE DRAWER

BACKGROUND OF THE INVENTION

The present invention relates to a packaging box, and more particularly to a packaging box that converts from a display box to a gift box.

It is recognized in the retail marketing art that visually displaying a product inside its packaging may enhance the retail sale of that product. This display is often accomplished by placing the product inside a display box, which is typically a box that has a window opening, so that the product can be seen within the package. Usually, the window opening is covered with a transparent film to protect the package contents.

Customers often want a retailer to gift-wrap a product purchase, so that the product is hidden in a visually pleasing package when given to a gift recipient. Ordinarily, the retailer either wraps the display box with wrapping paper, or repackages the product in a gift box.

In order to save these gift-wrapping or repackaging expenses, several display boxes (i.e., packaging boxes with window openings) are designed to convert to gift boxes that hide a product that has previously been displayed through the window of the display box. For example, U.S. Pat. No. 4,955,469 entitled "Convertible Container" issued Sep. 11, 1990 to Hudspith discloses a one-piece box that uses a flap system to cover its display window when the box is used as a gift box. However, for the Hudspith box to remain in either its gift-box or display-box mode, a tab or tongue of the flap must remain tucked in a slit in the box.

Another convertible gift-box is described in U.S. Pat. No. 3,357,543 entitled "Display and Gift Box" issued Dec. 12, 1967 to Taggart, which discloses the use of two display boxes hinged together in book fashion. The display boxes convert to gift boxes by closing the "book" so that the window of each display box is covered by the opposing display box. However, the Taggart invention is limited to packaging products purchased in multiple units.

Other boxes cover the window opening to protect the package contents during shipping and handling. For example, U.S. Pat. No. 3,262,559 entitled "Package with Sliding Sleeve" issued Aug. 18, 1964 to Geiger discloses the use of a sliding cardboard sleeve that does not extend beyond the end of the box when either covering or uncovering the display box window. The sleeve remains on the box at all times. The Geiger box has limitations. For example, the length of the display window is limited to a maximum of half the length of the display box. Further, because the sleeve can slide from either covering or uncovering the window opening without extending beyond the end of the box, the sleeve is less likely to remain secure in the desired position. Lastly, the use of a sleeve that is a fraction of the length of the box detracts from the visual attractiveness of the packaging box.

SUMMARY OF THE INVENTION

The aforementioned problems are overcome in the present invention wherein a convertible packaging box includes a windowed outer sleeve and an open drawer received within the sleeve. The sleeve is open at one end to allow the drawer to be slid into the sleeve. The top of the sleeve includes a window opening. The drawer is open at its top to allow product to be placed into the drawer.

In the display mode, the drawer is positioned inside the sleeve so that the interior of the drawer is visible through the window opening in the sleeve; thus, any product inside the drawer is visible through the window opening. In the gift-box mode, the drawer is positioned inside the sleeve so that the interior of the drawer is not visible through the window opening in the sleeve; thus, any product inside the sleeve is not visible through the window opening.

The conversion of the packaging box of the present invention from a display box to a gift box does not require any manipulation of flaps, nor does the integrity of the packaging box depend upon the insertion of flap tabs into slits. Rather, conversion to the gift-box mode simply requires the withdrawal of the drawer from the sleeve, the rotation of the sleeve relative to the drawer so that the sleeve is "upside down," and the re-insertion of the drawer into the sleeve. The length of the display window opening of the present invention is not limited by a requirement that the sleeve remain on the drawer when converting from the display-box mode to the gift-box mode. Also, once in the gift-box mode, any gift-wrap design pattern on the exterior of the drawer is visible through the window opening of the sleeve, thus facilitating an attractive gift-box exterior decoration.

In a preferred embodiment, the outside of the sleeve is printed with a gift-wrap design; and at least the drawer portions visible when in the gift-box mode also are printed with the same design. Consequently, all exposed portions of the box, when in the gift-box mode, have a consistent and uniform appearance.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
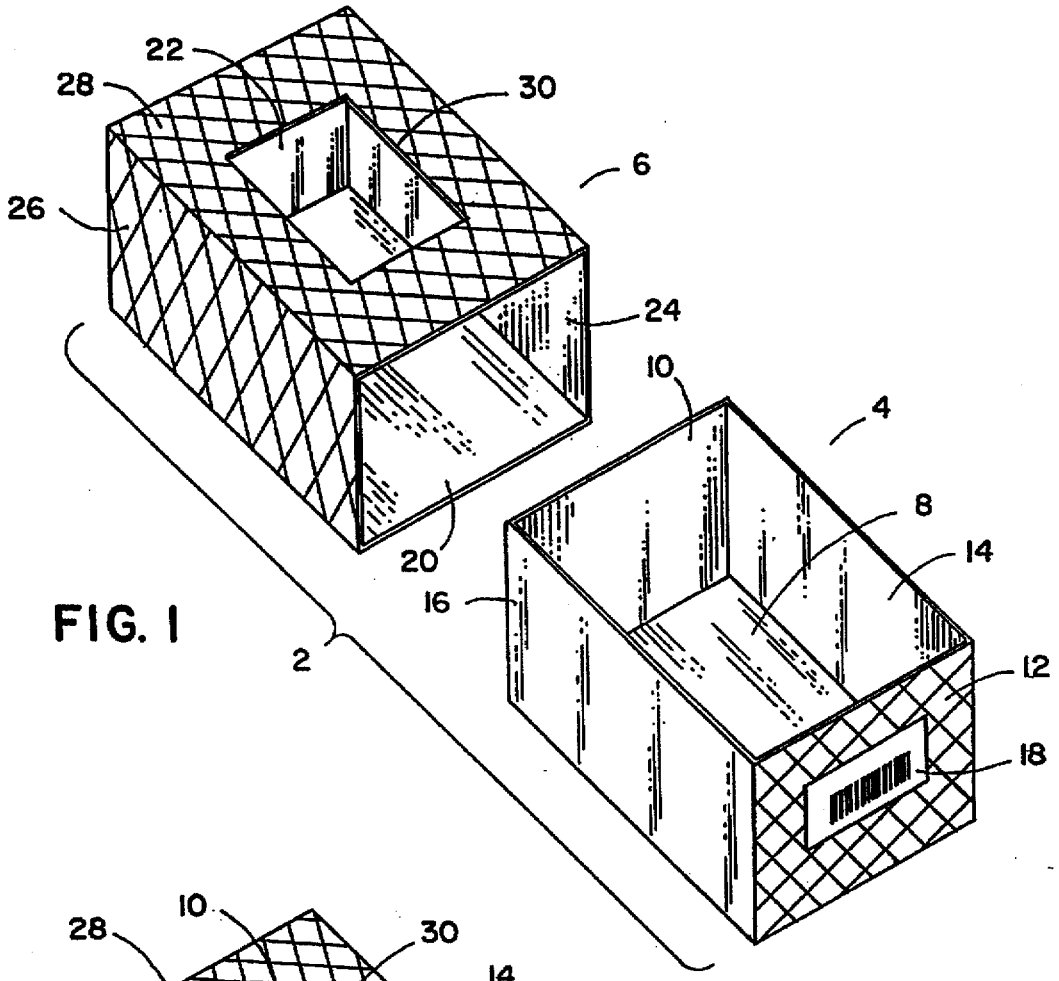
FIG. 1 is a perspective view of the packaging box of the present invention with the sleeve removed from the drawer.

A packaging box constructed in accordance with a preferred embodiment of the invention is illustrated in the drawings and generally designated 2. The box includes a sleeve and a drawer removably received within the sleeve. FIG. 1 shows packaging box 2 with drawer 4 withdrawn from sleeve 6. Drawer 4 and sleeve 6 are constructed using materials (e.g., cardboard and fiberboard) and methods that are known in the art.

Drawer 4 is a rectangular parallelepiped (e.g., a box) with bottom wall 8, back wall 10, front wall 12, and side walls 14 and 16. The top of drawer 4 is open; or, in other words, drawer 4 does not have a top wall. Preferably, printed information 18 is attached to (by way of a label) or printed on the exterior of front wall 12. Information 18 includes bar code or other information, for example, to identify the manufacturer and/or the package contents.

Sleeve 6 is also a rectangular parallelepiped with bottom wall 20, end wall 22, side walls 24 and 26, and top wall 28. The front end of sleeve 6 is open; or in other words, sleeve 6 does not have a front end wall. Sleeve 6 is only slightly larger than drawer 4, so that drawer 4 fits closely and firmly within sleeve 6, yet can be easily withdrawn from sleeve 6.

Top wall 28 of sleeve 6 defines a window or window opening 30. While a rectangular window is shown, the window may be of any shape, for example, to highlight a feature of a product within box 2. Sometimes, this window opening 30 is covered with a transparent film, as is known in the art, so that the contents of packaging box 2 are protected from dust and dirt, but still visible through window opening 30.

Figure 2:
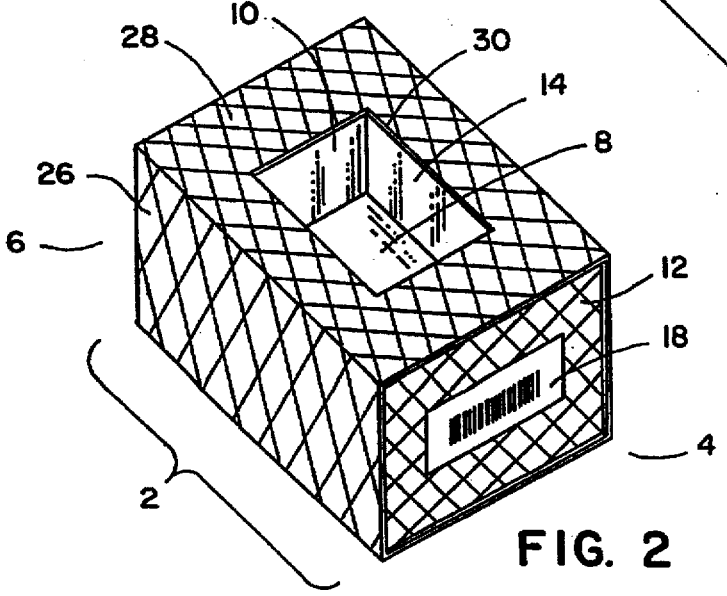
FIG. 2 is a perspective view of the packaging box in the display-box mode.

FIG. 2 shows packaging box 2 in the display-box mode, with drawer 4 positioned inside sleeve 6. The bottom wall 8 of the drawer 4 is adjacent to the bottom wall of the sleeve 6 (not visible), and the back wall 10 of the drawer 4 is adjacent to the back wall 10 of the sleeve 6 (not visible). Since the length of sleeve 6 is the same as the length of drawer 4, sleeve 6 fully covers the sides of drawer 4, leaving the end wall 12 of drawer 4 exposed. Consequently, the information 18 on the end of the drawer 4 is exposed, providing needed information to the consumer and retailer. The interior of drawer 4 is visible through window opening 30; thus, a product (not shown) within drawer 4 is visible through window opening 30.

Figure 3:
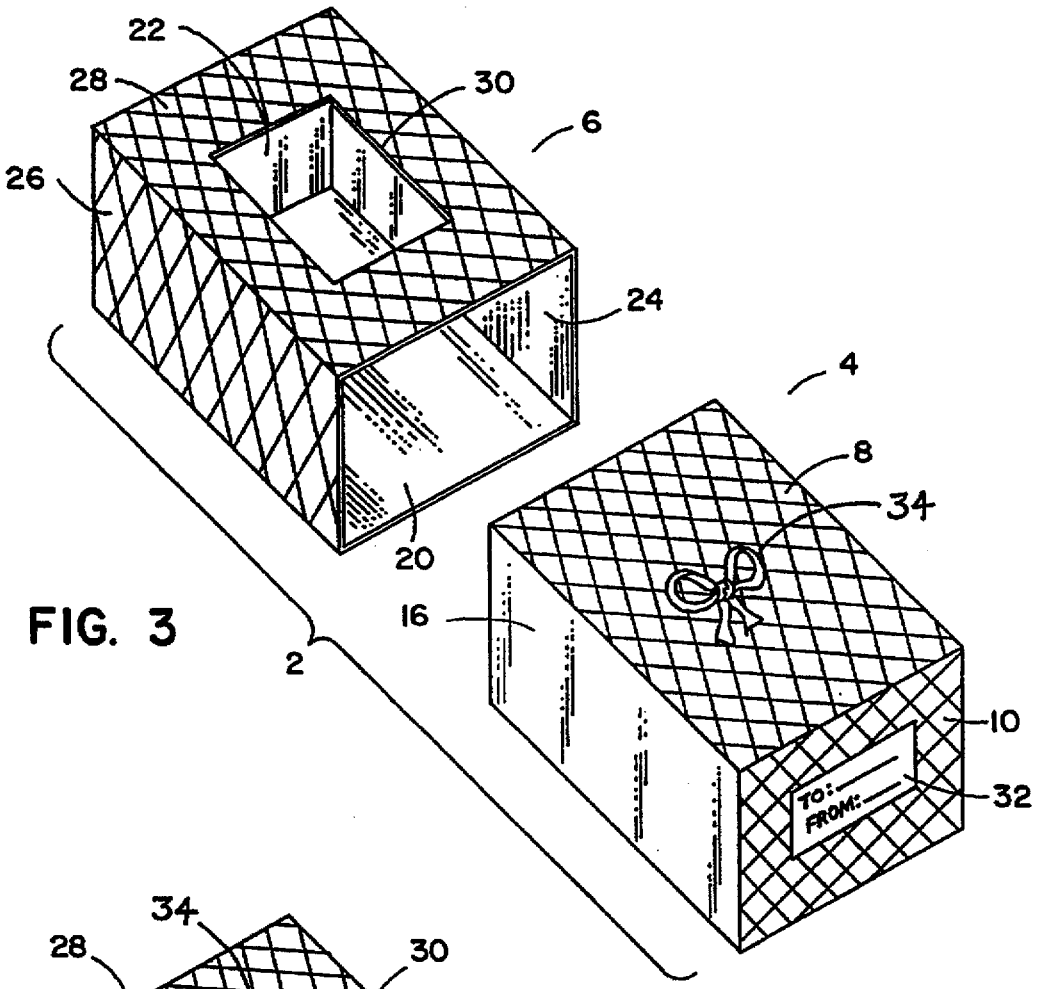
FIG. 3 is a perspective view of the packaging box with the sleeve removed from the drawer.
Figure 4:
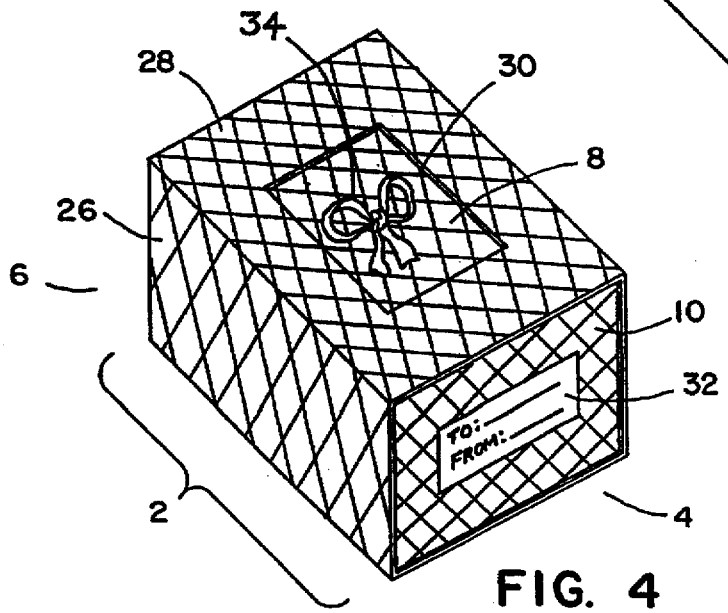
FIG. 4 is a perspective view of the packaging box in the gift-box mode.

FIG. 4 shows the box in the gift-box mode. To convert the packaging box from the display-box mode shown in FIG. 2 to the gift-box mode (discussed below), the sleeve 6 is removed from the drawer 4; the sleeve is rotated 180 degrees, turning the sleeve upside down relative to the drawer; the drawer is rotated 180 degrees relative to the sleeve so that the information 18 faces the back wall 22 of sleeve 6; and the sleeve is placed back onto the drawer so that the bottom wall of the drawer is adjacent to the top wall of the sleeve. FIG. 3 shows the packaging box 2 of the present invention prior to the placement of sleeve 6 onto drawer 4 to convert the packaging box to the gift-box mode. The exterior of the bottom wall 8 of the drawer 4 faces the same direction as the top wall 28 of the sleeve 6. The information 18 on the exterior of the front wall 12 of drawer 4 faces the back wall 22 of sleeve 6, as shown in FIG. 3.

In one aspect of the present invention, drawer 4 contains a gift tag 32 attached to or printed on the exterior of back wall 10 of drawer 4. The gift tag 32 may contain typical prompters such as "To:" and "From: ."

FIG. 4 shows the packaging box 2 of the present invention in the gift-box mode, with drawer 4 positioned inside sleeve 6. The bottom side 8 of drawer 4 is adjacent to the top side 28 of sleeve 6, and the back wall 10 of drawer 4 is visible through the open front of sleeve 6. Again, since the length of sleeve 6 is the same as the length of drawer 4, once drawer 4 is fully inserted into the sleeve, sleeve 6 covers the exterior of drawer 4, except for the exterior of back wall 10 of drawer 4. A portion of the exterior of bottom wall 8 of drawer 4 is visible through window opening 30. The interior of drawer 4 is not visible through window opening 30, since bottom wall 8 of the drawer 4 blocks the view. A piece of adhesive tape (not shown) can be used to secure drawer 4 in its fully inserted position within sleeve 6 during the gift-box mode.

Preferably, the exterior of sleeve 6 is covered or printed with a gift-wrap design pattern. Also preferably, the exterior portions of drawer 4 that are visible in the gift-box mode are covered or printed with a matching or visually compatible gift wrap design pattern. In FIG. 4, these visible exterior portions of drawer 4 are the exterior of back wall 10 of drawer 4, and the exterior portion of bottom wall 8 of drawer 4 that is visible through window opening 30. In another aspect, the exterior portion of bottom wall 8 of drawer 4 that is visible through window opening 30 has a decorative or simulated bow 34 printed on or attached to it.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A retail packaging box comprising:

a sleeve having a top wall, a bottom wall, a back wall, and two side walls joined to form a rectangular parallelepiped having an exterior surface and a flapless open end opposite said back wall, said top wall defining a window opening, said exterior surface of said sleeve beating a first complimentary design, said sleeve being substantially unapertured except for said open end and said window; and a drawer having an unapertured bottom wall, a back wall, a front wall, and two side walls joined to from a rectangular parallelepiped having an exterior surface, said exterior surface of said back and bottom walls of said drawer bearing a second complementary design, said exterior surface of said front wall of said drawer including product information, said drawer being movable between a display-box mode, wherein said drawer is inside said sleeve with said bottom wall of said drawer adjacent to said bottom wall of said sleeve and said back wall of said drawer adjacent to said back wall of said sleeve, and a gift-box mode, wherein said drawer is inside said sleeve with said bottom wall of said drawer adjacent to said top wall of said sleeve and said front wall of said drawer adjacent to said back wall of said drawer, whereby a product within said drawer is visible in the display-box mode and not visible in the gift-box mode, and further whereby said information is visible in the display-box mode and not visible in the gift-box mode, and further whereby visible surfaces of said sleeve and said drawer in the gift-box mode bear said design.

2. The packaging box of claim 1 wherein a gift tag is placed on the back wall of the drawer.

3. The packaging box of claim 1 wherein a portion of said second complimentary design includes a bow visible through said window when said drawer is in the gift-box mode.

4. A retail box comprising:

a drawer having an open top and an opposite bottom, an interior, an information end bearing product information, and an opposite end, said bottom and said opposite end bearing a first design; and a sleeve including opposite closed and open flapless ends, said sleeve slidably receiving said drawer within said sleeve through said open end in either a display orientation wherein said information end of said drawer is visible through said open sleeve end, or a gift-box orientation wherein said opposite end of said drawer is visible through said open sleeve end, said sleeve defining a window aligned with said open top when said drawer is in the display orientation, said sleeve bearing a second design complimentary to said first design, whereby said drawer interior is visible through said window and said information is visible through said open sleeve end when said drawer is in the display position, and further whereby said drawer block said window and said first design is visible through both said window and said open sleeve end when said drawer is in the gift-box orientation.

5. The box of claim 4 wherein the first design is the same as the second design.

6. A retail display and gift box comprising:

a sleeve defining a window, having an open flapless end, and otherwise being closed, said sleeve including an exterior printed with a design;

a drawer closely and slidably received within said sleeve through said open end, said drawer including an open top and otherwise being closed, said drawer further including a first end bearing product information and a second end printed with the design, said drawer being movable between a display position, wherein said open top is aligned with said window and said first drawer end bearing said information is exposed through said sleeve open end, and a gift-box position, wherein said drawer blocks said window and said second drawer end bearing the design is exposed through said sleeve open end.

7. A method of packaging a product comprising the steps of:

placing a product inside a drawer having an exterior, a bottom wall, a back wall, a front wall, and two side walls joined to form a rectangular-sided polyhedron configuration;

placing information on the exterior front wall of the drawer;

inserting the drawer holding the product inside a sleeve having an exterior, a top wall, a bottom wall, a back wall, and two side walls joined to form a rectangular-sided polyhedron configuration, the top wall defining a window opening, wherein the bottom wall of the drawer is adjacent to the bottom wall of the sleeve and the back wall of the drawer is adjacent to the back wall of the sleeve;

visually displaying the product within the package through the window opening;

withdrawing the drawer holding the product from the sleeve;

re-inserting the drawer holding the product inside the sleeve, wherein the bottom wall of the drawer is adjacent to the top wall of the sleeve, the front wall of the drawer is adjacent to the back wall of the sleeve, and wherein the product is not visible within the package.

8. The method of claim 7 further comprising the step of placing a gift tag on the back wall of the drawer.

9. The method of claim 7 further comprising the step of covering the sleeve exterior and the drawer back wall exterior with a gift-wrap design pattern.

10. The method of claim 9 further comprising the step of covering the bottom wall exterior of the drawer with a gift-wrap design pattern.

11. The method of claim 9 further comprising the step of covering with a gift-wrap design pattern a portion of the exterior bottom of the drawer that is subsequently visible through the window opening after the step of re-inserting the drawer.

12. The method of claim 11 further comprising the step of covering the portion with a bow.

* * * * *

UNITED STATES PATENT AND TRADEMARK OFFICE

CERTIFICATE OF CORRECTION

PATENT NO. : 5,673,796

DATED : October 7, 1997

INVENTOR(S) : John W. Tulloch

It is certified that error appears in the above-identified patent and that said Letters Patent is hereby corrected as shown below:

Column 4, Line 16:
"beating" should be --bearing--

Column 4, Line 21:
"from" should be --form--

Signed and Sealed this

Sixth Day of January, 1998

*Attest:*

*Attesting Officer*

BRUCE LEHMAN

*Commissioner of Patents and Trademarks*